US006059529A

United States Patent [19]

Schiavo

[11] Patent Number: 6,059,529

[45] Date of Patent: May 9, 2000

[54] TURBINE BLADE ASSEMBLY WITH COOLING AIR HANDLING DEVICE

[75] Inventor: Anthony Louis Schiavo, Oviedo, Fla.

[73] Assignee: Siemens Westinghouse Power Corporation, Orlando, Fla.

[21] Appl. No.: 09/039,644

[22] Filed: Mar. 16, 1998

[51] Int. Cl.[7] ..... F01D 5/08

[52] U.S. Cl. ..... 416/96 R; 416/95

[58] Field of Search ..... 415/115; 416/96 R, 416/97 R, 96 A, 95

[56] References Cited

U.S. PATENT DOCUMENTS

| | | | |
|---|---|---|---|
| 3,356,340 | 12/1967 | Bobo | 253/39.15 |
| 3,635,586 | 1/1972 | Kent et al. | 416/97 |
| 3,728,042 | 4/1973 | Hugoson et al. | 416/95 |
| 3,748,060 | 7/1973 | Hugoson et al. | 416/92 |
| 3,834,831 | 9/1974 | Mitchell . | |
| 3,853,425 | 12/1974 | Scalzo et al. | 416/95 |
| 4,019,831 | 4/1977 | Franklin et al. | 416/97 R |
| 4,073,599 | 2/1978 | Allen et al. | 416/97 |
| 4,118,136 | 10/1978 | Corsmeier . | |
| 4,244,676 | 1/1981 | Grondahl et al. | 416/92 |
| 4,292,008 | 9/1981 | Grosjean et al. | 415/115 |
| 4,312,625 | 1/1982 | Pinaire . | |
| 4,456,428 | 6/1984 | Cuvillier | 416/97 |
| 4,474,532 | 10/1984 | Pazder | 416/97 |
| 4,505,640 | 3/1985 | Hsing et al. . | |
| 4,531,889 | 7/1985 | Grondahl | 416/96 |
| 4,626,169 | 12/1986 | Hsing et al. | 416/95 |
| 5,117,626 | 6/1992 | North et al. | 60/39.75 |
| 5,318,404 | 6/1994 | Carreno et al. | 416/96 R |
| 5,536,143 | 7/1996 | Jacala et al. . | |
| 5,593,274 | 1/1997 | Carreno et al. | 415/115 |
| 5,941,687 | 8/1999 | Tubbs | 416/96 R |

FOREIGN PATENT DOCUMENTS 742477 12/1955 United Kingdom .

*Primary Examiner*—Edward K. Look
*Assistant Examiner*—Richard Woo
*Attorney, Agent, or Firm*—Eckert Seamans Cherin & Mellott, LLC

[57] ABSTRACT

A turbine blade assembly including an airfoil portion, a root portion and a cooling air plenum tube. A cooling air flow path is formed in the root and airfoil portions of the blade and has first and second inlets and an outlet formed in the bottom of the root. The plenum tube has an open front end that forms a first supply port for receiving a flow of cooling air. Openings in the tube upper portion form first and second discharge ports and a second supply port. An open rear end of the tube forms a third discharge port. A baffle assembly within the plenum tube forms first, second, and third chambers and first and second passages. The first chamber receives cooling air from the first supply port and directs a first portion to the first discharge port, which then directs it to the first inlet of the cooling air flow path. The first chamber directs a second portion of the cooling air to the first passage which, in turn, directs it to the third chamber. From the third chamber the second portion of the cooling air is directed to the second discharge port, which then directs it to the second inlet of the cooling air flow path. The second chamber receives cooling air from the cooling flow path outlet via the second supply port and directs it to the second passage. The second passage then directs the cooling air to the third discharge port, which directs it away from the turbine blade, preferably, for return to the cooling air system.

17 Claims, 4 Drawing Sheets

FIG.1
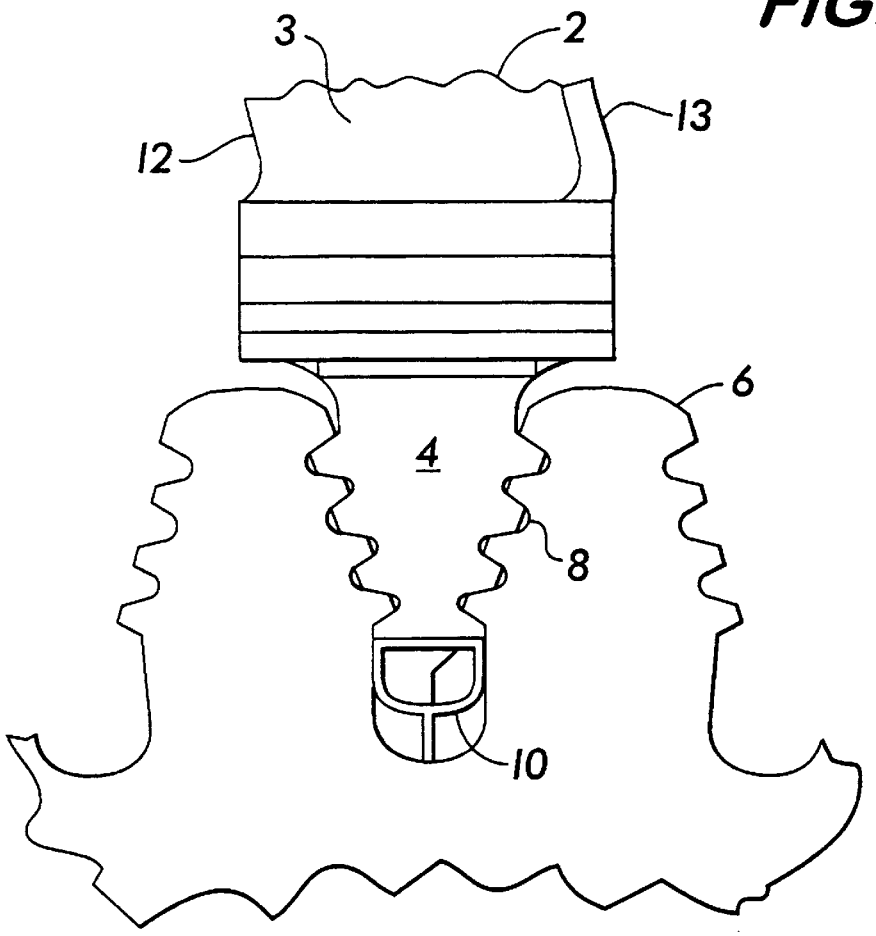
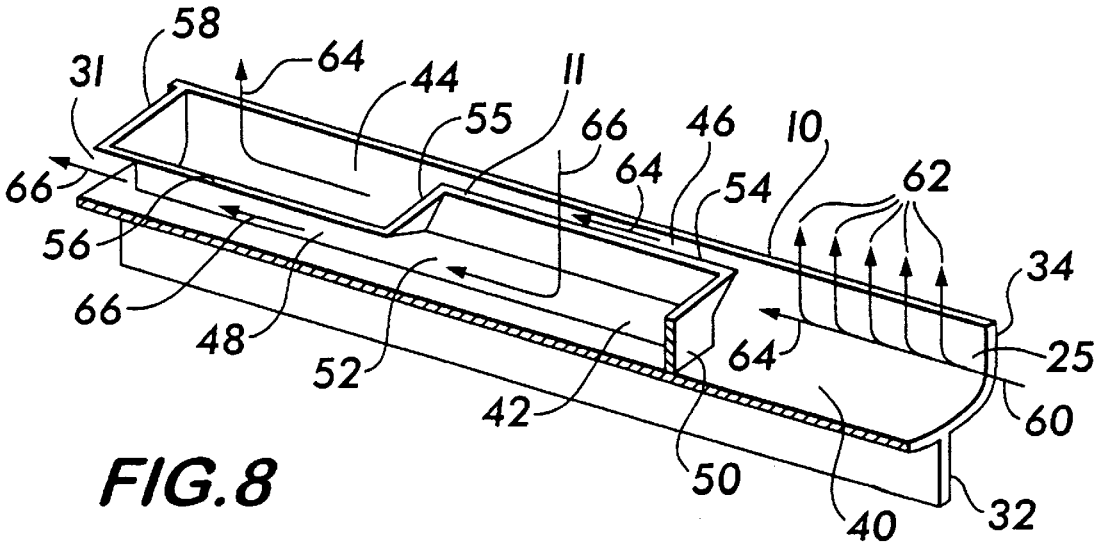
FIG.8

FIG.5
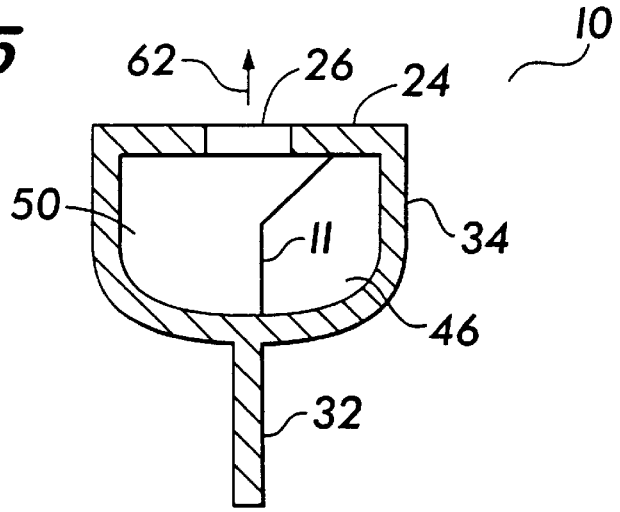
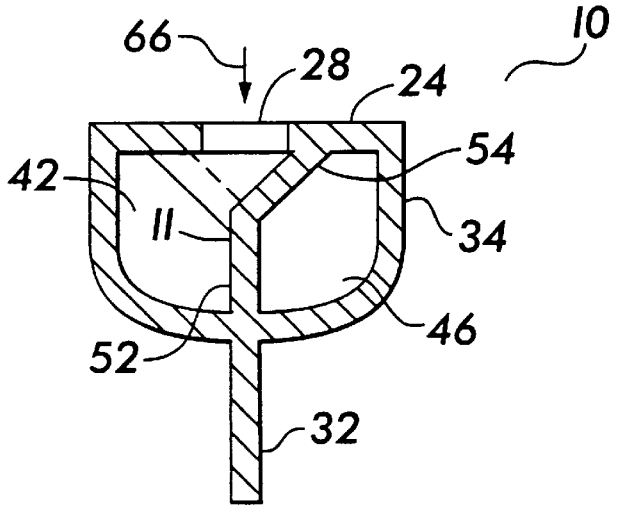
FIG.6
FIG.7
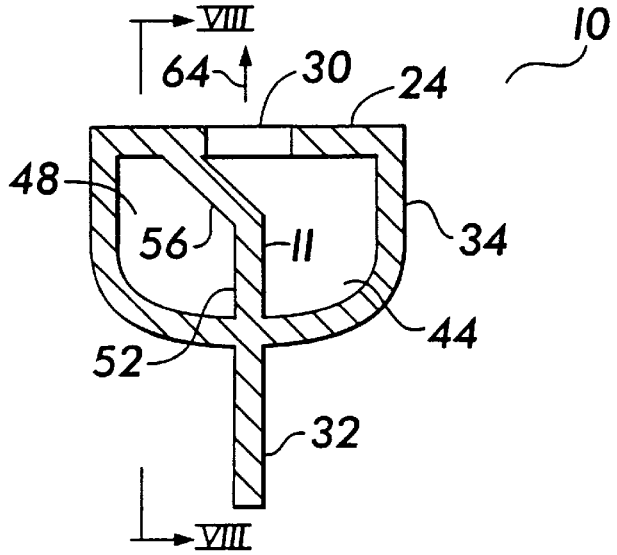

TURBINE BLADE ASSEMBLY WITH COOLING AIR HANDLING DEVICE

BACKGROUND OF THE INVENTION

The present invention relates to a rotating blade for use in a turbomachine such as a gas turbine. More specifically, the present invention relates to a gas turbine rotating blade having a handling device for directing cooling air for the blade cooling air passages.

The turbine section of a gas turbine includes a rotor that is comprised of a series of disks to which blades are affixed. Hot gas from the combustion section flows over the blades, thereby imparting rotating power to the rotor shaft. In order to provide maximum power output from the gas turbine, it is desirable to operate with gas temperatures as high as possible. However, operation at high gas temperatures requires cooling the blades. This is so because the strength of the material from which the blades are formed decreases as its temperature increases.

Traditionally, turbine blades are cooled by flowing cooling air through the blades. Typically, the cooling air is extracted from the air discharging from the compressor section, thereby bypassing the combustion process, and directed to the turbine rotor. The rotor directed the cooling air to the roots of the blades. From the blade root, the air is directed to flow through a number of cooling passages formed in the airfoil portion of the blade. These passages typically terminated at openings formed in the surface of the blade, such as at the tip and the leading and trailing edges. Thus, after cooling, the spent cooling air was discharged to the hot gas flowing through the turbine section and discharged from the turbine exhaust. Such a turbine blade cooling scheme is shown in U.S. Pat. No. 5,117,626 (North et al.), hereby incorporated by reference in its entirety. In this approach, it is often difficult to properly distribute the cooling air to the various cooling passage inlets formed in the root portion of the blade.

Moreover, recently, efforts have been aimed at developing closed loop cooling systems in which the spent cooling air is returned to the compressor discharge air, or directly into the combustor, for incorporation into the combustion process. Alternatively, a closed loop cooling system may be utilized in which the spent cooling air is cooled and returned to the turbine rotor for further cooling. Unfortunately, such closed loop cooling air systems further exacerbate the air handing problem, since not only must the supply cooling air be distributed to the cooling passages but the discharged cooling air must be collected from the cooling air passages for return to the system. This additional air handling problem can further complicate the geometry of the cooling passages within the blade.

It is therefore desirable to provide a device for distributing cooling air to the cooling air passages of a turbine blade and, in closed loop systems, for collecting the spent cooling air from the cooling passages as well.

SUMMARY OF THE INVENTION

Accordingly, it is the general object of the current invention to provide a device for distributing cooling air to the cooling air passages of a turbine blade and, in closed loop systems, for collecting the spent cooling air from the cooling passages as well.

Briefly, this object, as well as other objects of the current invention, is accomplished in a turbine blade assembly comprising a root portion, an airfoil portion, and a cooling fluid handling device. A cooling fluid flow path is formed in the root portion and has a first inlet and an outlet. The cooling fluid handling device includes a first supply port for receiving a flow of cooling fluid and a first discharge port. The first discharge port is in flow communication with the cooling fluid flow path first inlet so that the first discharge port discharges at least a first portion of the flow of cooling fluid into the cooling fluid flow path first inlet. The cooling fluid handling device also includes a second supply port. The second supply port is in flow communication with the cooling fluid flow path outlet so that the second supply port receives at least a portion of the flow of cooling fluid discharged into the cooling fluid flow path first inlet.

In one embodiment, the cooling fluid flow path further comprises a second inlet, and the fluid handling device further comprises a second discharge port. The second discharge port is in flow communication with the second inlet so that the second discharge port discharges a second portion of the flow of cooling fluid into the cooling fluid flow path second inlet.

In another embodiment, the cooling fluid handling device further includes a third discharge port in flow communication with the second supply port so that the cooling fluid received by the second supply port can be directed away from the turbine blade.

BRIEF DESCRIPTION OF THE DRAWINGS

FIG. 1 is a view of a turbine blade incorporating the cooling air handling tube of the current invention as installed in the turbine rotor.

FIG. 5 is a transverse cross-section taken through section V—V, shown in FIG. 4.

FIG. 6 is a transverse cross-section taken through section VI—VI, shown in FIG. 4.

FIG. 7 is a transverse cross-section taken through section VII—VII, shown in FIG. 4.

FIG. 8 is an isometric view similar to FIG. 3 but taken through section VIII—VIII, shown in FIG. 7, and in which the cover has been removed for clarity.

DESCRIPTION OF THE PREFERRED EMBODIMENT

Figure 2:
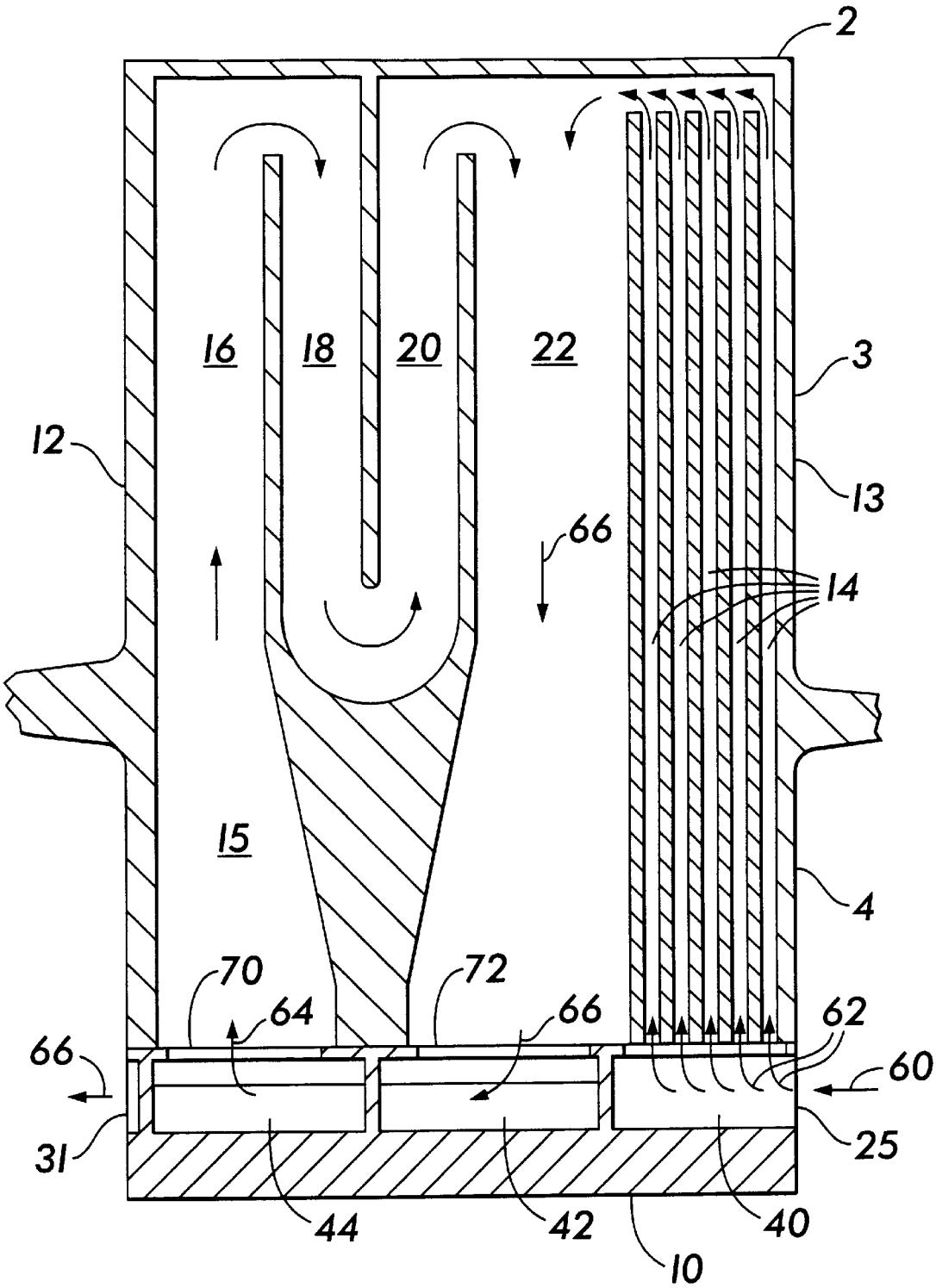
FIG. 2 is a longitudinal cross-section, partially schematic, taken through the turbine blade shown in FIG. 1.

Referring to the drawings, there is shown in FIG. 1 a turbine blade assembly according to the current invention installed in a rotor 6. The blade assembly is comprised of a turbine blade 2 and a cooling air handling device 10. As is conventional, the turbine blade 2 is comprised of an airfoil portion 3 and a root portion 4. The airfoil portion 3 has a base portion adjacent the root 4 and a tip portion at its distal end. Thus, the tip portion of the airfoil 3 forms one end of the blade 2 and the root portion 4 forms the other end of the blade. The airfoil portion 3 of the blade 2 is formed by a generally concave shaped wall, which forms the pressure surface of the airfoil, and a generally convex wall, which forms the suction surface of the airfoil. At their upstream and downstream ends, the walls meet and form the leading and trailing edges 12 and 13, respectively, of the airfoil 3.

As shown in FIG. 2, the airfoil 3 is substantially hollow, with its interior forming a cooling air flow path. The cooling air flow path comprises first and second portions that merge in passage 22 and terminate in a single outlet 72 formed in the bottom of the blade root 4. The first portion of the cooling air flow path is formed by a plurality of radially extending passages 14 formed in the portion of the blade adjacent the trailing edge 13. Each of the radial passages 14 has an opening formed at the bottom of the blade root 4. These openings form an inlet for the first portion of the cooling air flow path. The radial passages 14 extend through the root 4 and airfoil 3, terminating at openings located adjacent the blade tip.

The second portion of the cooling air flow path is formed by a serpentine passage 15. The serpentine passage 15 has an inlet 70 located at the bottom of the root 4. Radial passages 16–22 connect the inlet 70 to the outlet 72. In the preferred embodiment of the invention, there are no cooling air outlets in the airfoil surface that allow the cooling air to exit the airfoil 3 and enter the hot has flowing over the blade 2. Consequently, all of the cooling air supplied to the blade 2 is discharged through the cooling flow path outlet 72 formed in the blade root 4.

As shown in FIG. 1, the blade root 4 is secured to a groove 8 in the rotor 6 by means of serrations formed in the root that engage mating serrations formed in the groove 8, as is conventional. According to the current invention, however, an elongate cooling air handling device 10, or plenum tube, is disposed underneath the root 4, between the bottom of the root and the bottom of the groove 8. Preferably, the plenum tube 10 is welded or brazed to the bottom surface of the blade root 2. As shown in FIG. 3–8, the plenum tube 10 comprises an approximately U-shaped channel 34 enclosed by a cover 24. A longitudinally extending fin 32 ensures that the plenum tube 10 will be properly positioned in the rotor groove 8 in the event that the joint between the tube and the blade root 4 is broken.

Figure 3:
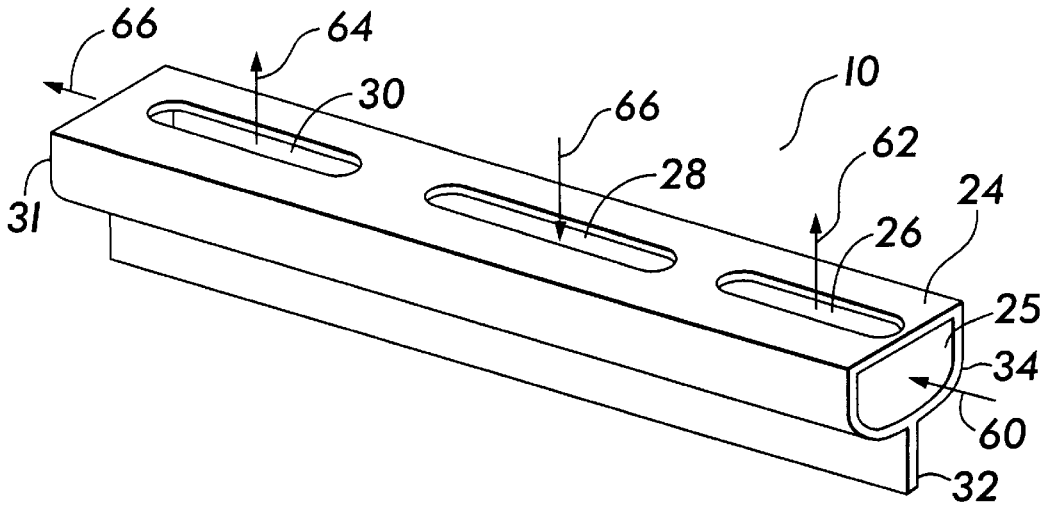
FIG. 3 is isometric view of the cooling air handling device shown in FIG. 1.
Figure 4:
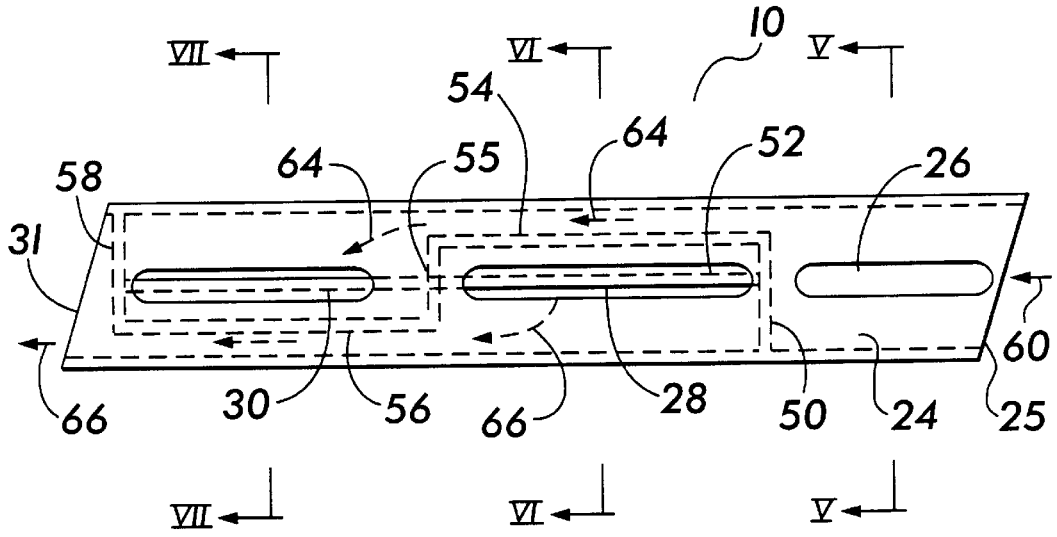
FIG. 4 is a plan view of the cooling air handling device shown in FIG. 3.

As shown best in FIGS. 3 and 8, the front and rear ends of the plenum tube 10 are open. The open front end forms a first supply port 25 for the tube 10. As shown best in FIGS. 3 and 4, three openings are formed in the cover 24. The first and third openings form first and second discharge ports 26 and 30, respectively. The open end at the rear of the tube 10 forms a third discharge port 31. The second opening in the cover 24 forms a second supply port 28.

As shown best in FIGS. 5–8, a baffle assembly 11 is located within the interior of the plenum tube 10. Preferably, the baffle assembly 11 extends approximately two thirds the length of the plenum tube 10. The baffle assembly comprises walls 50–56. Wall 52 is vertically oriented and extends longitudinally along the center of the plenum tube 10. Walls 50 and 58 are also vertically oriented but extend transversely at the front and rear, respectively, of the baffle assembly 11. The walls 50 and 58 block only a portion of the cross-sectional area of the interior of the plenum tube 10, thereby permitting the wall 52 to form longitudinally extending passages 46 and 48. Walls 54 and 56 are inclined and extend from the upper edge of the low wall 52 to the cover 24. The walls 54 and 56 are inclined in opposite transverse directions, as shown best in FIGS. 6 and 7. Wall 55 connects walls 54 and 56 at approximately midway along the length of the baffle assembly 11.

As a result of this geometry, the baffle assembly 11 partitions the interior of the plenum tube 10 into first, second, and third plenum chambers 40, 42 and 44, and first and second longitudinally extending passages 46 and 48, as shown best in FIG. 8. The first passage 46 is located along side the second chamber 42 and connects the first and third chambers 40 and 44, respectively. The second passage 48 is located along side the third chamber 44 and connects the second chamber 42 to the third discharge port 31.

Preferably, the plenum tube 10 is machine or cast from a metal alloy. However, it can also be formed from a ceramic material.

In operation, cooling air 60 supplied to the rotor 6 is directed to the supply port 25 formed in the front end of the plenum tube 10, whereupon it enters the first chamber 40. A first portion 62 of the cooling air 60 exits the first chamber 40 through first discharge port 26 formed in the cover 24 and enters the radial passages 14 of the cooling air flow path, as shown best in FIGS. 2 and 8. Thus, the first chamber 40 acts as a manifold that distributes the first cooling air portion 62 to the openings for each of the radial passages 14.

A second portion 64 of the cooling air 60 flows through the first chamber 40 to passage 46, which directs it to the third chamber 44. From the third chamber 44, the second cooling air portion 64 exits through the second discharge port 30 and enters the inlet 70 of the serpentine passage 15. The second cooling air portion 64 then flows through passages 16, 18 and 20 of the serpentine passage 15 to passage 22. In passage 22, the second cooling air portion 64 is combined with the first cooling air portion 62 exiting the radial passages 14. The combined flow of cooling air 66 then flows through passage 22 to the cooling air flow path outlet 72.

From the cooling flow path outlet 72, the cooling air 66 reenters the plenum tube 10 through the second supply port 28 and flows into the second chamber 42. Passage 48 then directs the cooling air 66 from the second chamber 42 to the plenum tube third discharge port 31, which directs it away from the turbine blade 2 for return to the cooling system.

By distributing the cooling air 60 to the various cooling air passages formed in the blade and then collecting the spent cooling air from the cooling air passages and directing it away from the blade, the plenum tube 10 considerably simplifies the handling of the cooling air, especially when, as described in the preferred embodiment, the plenum tube is used in a closed loop cooling air scheme. In addition, by adjusting the size of the openings 26-30 in the cover 24, the flow rate of cooling air to the various passages can be accurately metered. In this regard it should be noted that although in the preferred embodiment the discharge ports 26 and 30 and the supply port 28 are formed by openings in the cover 24, the cover could be dispensed with, in which case the discharge ports 26 and 30 would be formed by the open tops of chamber 40 and 44, respectively, and the supply port 28 would be formed by the open top of chamber 42.

Although the invention has been discussed with reference to a closed loop cooling air system for a turbine blade, the invention is also applicable to open looped cooling air systems, as well as cooling systems utilizing a cooling fluid other than air. Consequently, the present invention may be embodied in other specific forms without departing from the spirit or essential attributes thereof and, accordingly, reference should be made to the appended claims, rather than to the foregoing specification, as indicating the scope of the invention.

I claim:

1. A turbine blade assembly, comprising:

a) a root portion and an airfoil portion, a cooling fluid flow path formed in at least said root portion, said cooling fluid flow path having a first inlet and an outlet;

b) a cooling fluid handling device disposed adjacent said root portion, said handling device having (i) a first supply port for receiving a flow of cooling fluid and communicating the cooling fluid through a first cooling flow channel, (ii) a first discharge port, said first discharge port in flow communication with said cooling fluid flow path first inlet, whereby said first discharge port discharges at least a first portion of said flow of cooling fluid communicated through the first cooling flow channel into said cooling fluid flow path first inlet, and (iii) a second supply port, said second supply port in flow communication with said cooling fluid flow path outlet, whereby said second supply port receives at least a portion of said flow of cooling fluid discharged into said cooling fluid flow path first inlet and communicates the cooling fluid through a second cooling flow channel; and whereby the first and second cooling flow channels are defined by a common tubular member further comprising a baffling assembly separating the respective flow channels.

2. The turbine blade assembly according to claim 1, wherein:

a) said cooling fluid flow path further comprises a second inlet, and b) said fluid handling device further comprises a second discharge port, said second discharge port in flow communication with said second inlet and said first cooling channel, whereby said second discharge port discharges a second portion of said flow of cooling fluid into said cooling fluid flow path second inlet.

3. The turbine blade assembly according to claim 2, wherein both said first and second fluid flow path inlets are in flow communication with said fluid flow path outlet, whereby said fluid handling device second supply port receives said first and second portions of said flow of cooling fluid.

4. The turbine blade assembly according to claim 1, wherein said cooling fluid flow path comprises a plurality of passages extending radially outward from said root into said airfoil, each of said passages having an opening formed in said root, and wherein said first cooling fluid flow path inlet comprises said passage openings.

5. The turbine blade assembly according to claim 4, wherein said fluid handling device has a first chamber formed therein, said first chamber forming a manifold for distributing said first portion of said flow of cooling fluid to each of said passage openings and forming at least a portion of said first cooling flow channel.

6. The turbine blade assembly according to claim 1, wherein said baffle assembly partitions said interior of said essentially tubular member into at least first and second chambers wherein said second chamber forms at least part of said second cooling flow channel.

7. The turbine blade assembly according to claim 6, wherein said first chamber is in flow communication with said first supply port and said first discharge port, whereby said first portion of said flow of cooling fluid flows from said first supply port through said first chamber and into said first discharge port.

8. The turbine blade assembly according to claim 7, wherein said fluid handling device further comprises a second discharge port, said second discharge port is in flow communication with said second supply port and said second chamber, whereby said portion of said flow of cooling fluid received by said second supply port flows through said second chamber and into said second discharge port.

9. The turbine blade assembly according to claim 8, wherein:

a) said cooling fluid flow path further comprises a second inlet;

b) said fluid handling device further comprises a third discharge port, said third discharge port in flow communication with said second inlet of said cooling fluid flow path, whereby said third discharge port discharges a second portion of said flow of cooling fluid into said cooling fluid flow path second inlet; and c) said baffle assembly further partitions said interior of said essentially tubular member into a third chamber, said third chamber in flow communication with said third discharge port and said first chamber through said first cooling flow channel, whereby said second portion of said flow of cooling fluid received by said first supply port flows from said first chamber through said third chamber and into said third discharge port.

10. A turbine blade assembly, comprising:

a) a root portion and an airfoil portion, a cooling fluid flow path formed in at least said root portion, said cooling fluid flow path having a first inlet and an outlet; and b) a cooling fluid handing device disposed adjacent said root, said handling device comprising (i) an essentially tubular member, said essentially tubular member having first and second cooling fluid supply ports and first and second cooling fluid discharge ports formed therein, and (ii) a baffle assembly disposed within said tubular member, said baffle assembly forming first and second chambers within said essentially tubular member, said first chamber in flow communication with said first cooling fluid supply port and said first cooling fluid discharge port.

11. The turbine blade assembly according to claim 10, wherein said second chamber is in flow communication with said second cooling fluid supply port and said second cooling fluid discharge port.

12. The turbine blade assembly according to claim 10, wherein a) said cooling fluid flow path further comprises a second inlet;

b) said essentially tubular member further comprises a third discharge port formed therein; and c) said baffle assembly forms a third chamber within said essentially tubular member, said third chamber in flow communication with said third discharge port and said first chamber.

13. The turbine blade assembly according to claim 12, wherein said baffle assembly forms a passage within said essentially tubular member, said passage extending at least from said first chamber to said third chamber.

14. The turbine blade assembly according to claim 13, wherein said second chamber is in flow communication with said second cooling fluid supply port and said second cooling fluid discharge port, and wherein said second chamber is disposed between said first and third chambers, said baffle assembly separating said second chamber from said passage.

15. A cooling fluid handling device for a turbine blade, comprising:

a) an elongate essentially tubular member forming a cavity therein, said member having at least first and second supply ports for receiving cooling fluid and at least a first discharge port for discharging cooling fluid; and b) a baffle assembly disposed within said member and dividing said cavity into at least first and second chambers and at least a first passage, (i) said first chamber in flow communication with said first supply port and said first discharge port, whereby at least a first portion of cooling fluid received by said first supply port flows through said first chamber to said first discharge port, and (ii) said second chamber in flow communication with said second supply port and said first passage, whereby at least a first portion of said cooling fluid received by said second supply port flows through said second chamber to said first passage.

16. The cooling fluid handling device according to claim 15, wherein:

a) said member further comprises a third discharge port; and b) said baffle assembly further divides said cavity into a second passage, said second passage in flow communication with said first supply port and said third discharge port, whereby a second portion of said cooling fluid received by said first supply port flows through said second passage to said third discharge port.

17. The cooling fluid handling device according to claim 16, wherein:

a) said baffle assembly further divides said cavity into a third chamber, said second chamber being disposed between said first and third chambers;

b) said first passage is disposed along side said third chamber; and c) said second passage is disposed along side said second chamber.

* * * * *